US005341634A

United States Patent [19]

Straight

[11] Patent Number: 5,341,634

[45] Date of Patent: Aug. 30, 1994

[54] INTERLOCKING LINK CHAIN

[76] Inventor: Christian L. Straight, 235 E. Santa Clara St. #1102, San Jose, Calif. 95113

[21] Appl. No.: 464

[22] Filed: Jan. 5, 1993

[51] Int. Cl.[5] ..... A44C 5/02

[52] U.S. Cl. ..... 59/80; 59/78; 59/90; 59/91; 63/4

[58] Field of Search ..... 59/1, 13, 14, 80, 82, 59/90, 91, 35.1, 78; 63/4, 5.2, 3, 11; 2/311

[56] References Cited

U.S. PATENT DOCUMENTS

| | | | |
|---|---|---|---|
| 216,533 | 6/1879 | Rumpp | 59/90 |
| 1,397,458 | 11/1921 | Sandquist | 59/91 |
| 1,797,968 | 3/1931 | Sweeney | 59/80 |
| 2,169,265 | 8/1939 | Mantz | 59/91 |
| 2,355,944 | 8/1944 | Beggs | 63/4 |
| 3,368,344 | 2/1968 | Graetz | 59/78 |
| 3,418,803 | 12/1968 | Martin | 59/78 |

FOREIGN PATENT DOCUMENTS

| | | | |
|---|---|---|---|
| 88227 | 11/1959 | Denmark | 59/80 |
| 1221705 | 6/1960 | France | 59/80 |

*Primary Examiner*—David Jones
*Attorney, Agent, or Firm*—James J. Leary

[57] ABSTRACT

An interlocking link chain for use in jewelry and other decorative items. The interlocking links can be assembled and disassembled by the wearer without special tools and without an unusual degree of dexterity. The wearer can assemble a chain of any length for use as a bracelet, a necklace, a belt, or other decorative items. Each link has a tab portion and a slot portion. Each link may also have a body portion which expresses an artistic or decorative motif. In some embodiments, the tab and the slot may be made an integral part of the decorative motif. The links are arranged in a linear chain so that the tab portion of each link interlocks with the slot portion of the adjacent link. The links are made in a generally planar configuration that lends itself to low cost manufacturing methods, such as sheet metal forming techniques or injection molding.

8 Claims, 5 Drawing Sheets

INTERLOCKING LINK CHAIN

FIELD OF THE INVENTION

This invention relates to a chain with removable interlocking links. More particularly, it relates to a chain with interlocking links that can be used in jewelry or other decorative articles.

BACKGROUND OF THE INVENTION

Chains with removable interlocking links are well known in the jewelry industry. Many watchbands and bracelets are made with removable interlocking links so that the band or bracelet can be adjusted to the size of the wearer's wrist. Two examples of this can be found in U.S. Pat. Nos. 3,857,237 for a Wristlet and 4,638,627 for a Wristlet Having Links. In general, this type of interlinking jewelry chain has complex links which are complicated and expensive to manufacture. Often these chains are also difficult to assemble, requiring special tools and a high degree of skill to add or remove links from the chain. Most people would have to bring the chain or watchband to a jeweler to have it lengthened or shortened.

Other jewelry chains have been made with simpler interlocking links. Two examples are shown in U.S. Pat. No. 4,448,017 for a Jewelry Chain Loop Element and Method of Assembly and U.S. Pat. No. 4,763,489 for Modular Jewelry. Though these chain links are simple enough to assemble that the wearer could assemble their own chain of the desired length, they still would require specialized jewelry manufacturing techniques to make the links. U.S. Pat. No. 4,790,797 shows a Link Chain which lends itself to lower cost sheet metal manufacturing techniques. This chain, however, cannot not be easily assembled or disassembled by the wearer. It is desirable, therefore, to provide an interlocking link chain suitable for jewelry with easily removable links that lends itself to low cost manufacturing techniques.

SUMMARY OF THE INVENTION

In keeping with the foregoing discussion, it is an objective of the present invention to provide an interlocking link chain suitable for use in jewelry and other decorative items. It is also an objective to make the interlocking links so that they can be assembled and disassembled by the wearer without special tools and without an unusual degree of dexterity. This gives the present invention the advantage that the wearer can assemble a chain of any length for use as a bracelet, a necklace, a belt, or other decorative items. it is an overall objective of the invention that the links of the chain should be easily manufacturable by low cost manufacturing methods such as sheet metal forming techniques or injection molding.

The invention takes the form of a chain made up of interlocking links. Each link has a tab portion and a slot portion. Each link may also have a body portion which expresses an artistic or decorative motif. In some embodiments, the tab and the slot may be made an integral part of the decorative motif. The links are arranged in a linear chain so that the tab portion of each link interlocks with the slot portion of the adjacent link. Any number of links may be assembled together to make a chain of the desired length. The links are made in a generally planar configuration that lends itself to low cost manufacturing methods. Other objects and advantages of the invention will no doubt occur to those skilled in the art upon reading and understanding the following detailed description along with the accompanying drawings.

DETAILED DESCRIPTION OF THE INVENTION

Figure 1:
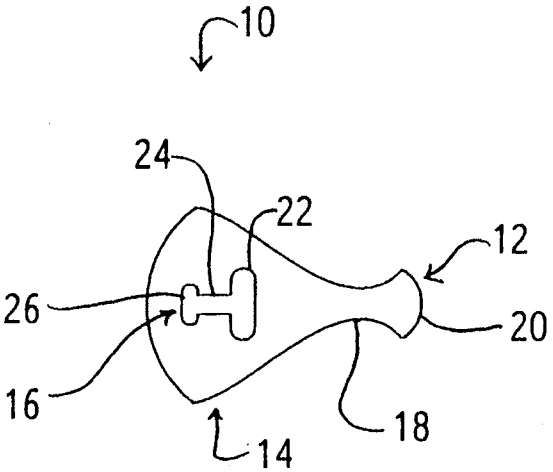
FIG. 1 shows a single chain link used to make the interlocking link chain.

FIG. 1 shows a chain link 10 which exemplifies the present invention. The chain link 10 has a tab portion 12, a body portion 14 and a slot portion 16. The tab portion 12 extends from one side of the body 14. The tab 12 is characterized by a narrow neck 18 which widens to form the head 20 of the tab 12. The slot portion 16 is located on the body 14 of the link 10. The slot 16 is characterized by a mouth 22, which is wide enough to allow insertion of the head 20 of the tab, connected by a narrow throat 24 to the base 26 of the slot which is wide enough to accommodate the neck 18 of the tab 12, but too narrow for the head 20 of the tab 12 to pass through. The body 14 of the chain link 10 in this embodiment has a simple geometric motif.

Figure 2:
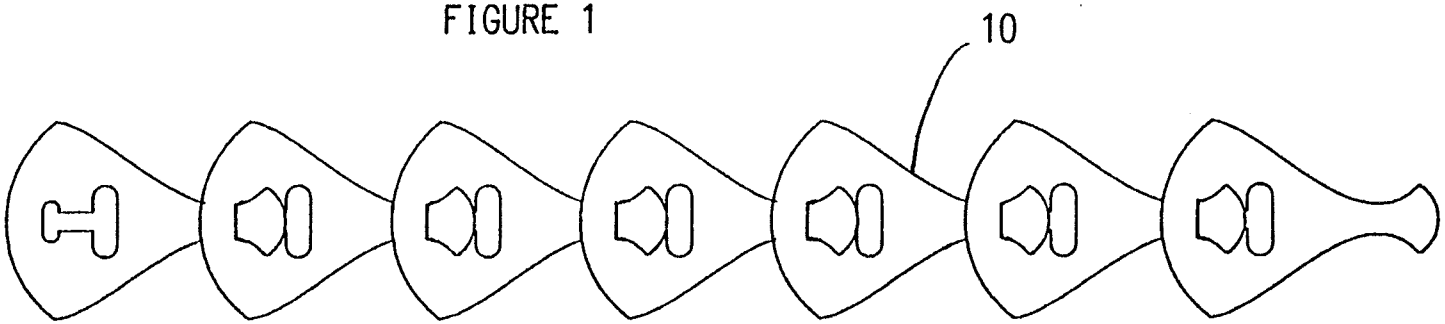
FIG. 2 shows an interlocking link chain assembled from seven chain links.
Figure 3A:
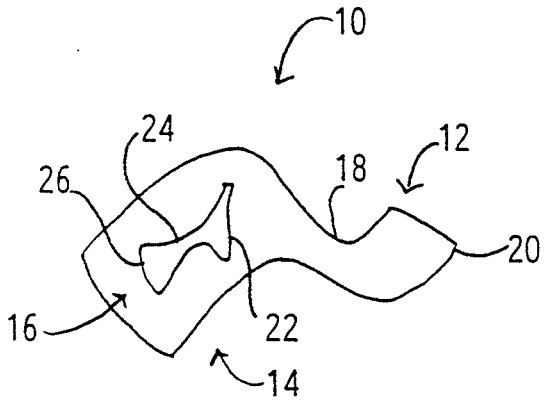
FIGS. 3 A–D show variations of the chain links having abstract motifs.
Figure 3B:
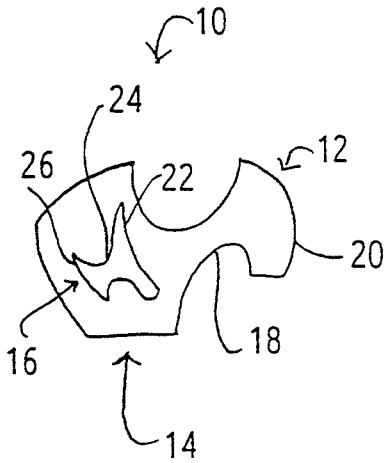
Figure 3C:
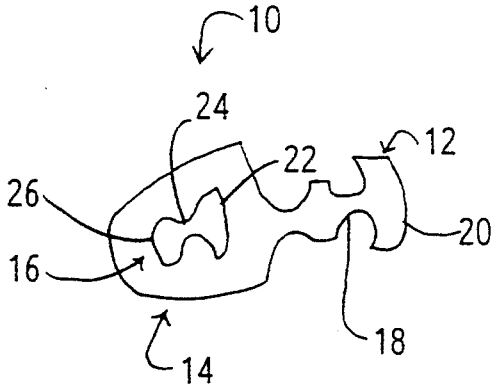
Figure 3D:
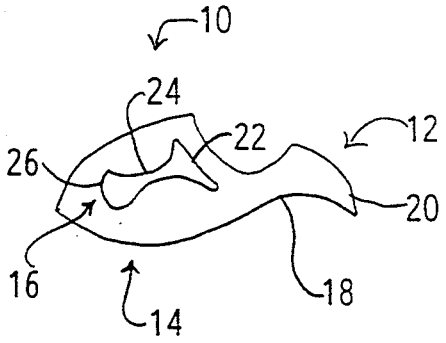

Several of the links 10 shown in FIG. 1 may be assembled together to form a chain as shown in FIG. 2. This is done by inserting the head 20 of one link through the mouth 22 of a second link until the neck 18 of the first link is in the mouth 22 of the second link. The first link is rotated approximately 90 degrees so that the neck 18 of the first link will pass through the throat 24 in the second link until it is in the base 26 of the slot 16. Then the first link is rotated back again and the two links are interlocked. This process is repeated, adding one link at a time until the chain has reached the desired length, then the ends of the chain are linked together to form a loop. FIG. 2 shows a seven-link chain which is approximately the right length for a woman's bracelet. More links may be added to make the chain longer to use it as a necklace or a belt.

The links 10 are preferably made of a decorative material. For fine jewelry, the chain links may be made of precious metals such as gold or silver. For costume jewelry, the chain links may be made of semiprecious metals, such as copper or copper alloys or of colorfully painted or enameled metal. Interesting visual affects for costume jewelry could also be achieved by making the chain links out of colorful plastic or other decorative materials such as horn or shell.

Because of the corresponding geometry of the tabs and the slots, the links are firmly interlocked when they are assembled. It is highly unlikely that they will become inadvertently detached, yet it is a simple matter for the wearer to deliberately detach the chain at any point to take off the jewelry or to add or subtract links. The attachment of chain links is actually enhanced when there is tension on the chain, for instance when the chain is worn as a snugly fitting bracelet, because it keeps the tabs of the links firmly against the base of the slots. The attachment of the chain links to one another can also be enhanced by sizing the slot 16 so that there is a slight interference fit when the neck 18 passes through the throat 24 of the slot. This works best when the links are made of a resilient material such as plastic or a metal alloy that has some elasticity to it.

The simple geometric motif of the chain link in FIG. 1 forms a repeated geometric pattern when the links are joined together in a chain as shown in FIG. 2. Other visual effects can be achieved by joining together links with different geometric motifs. The links can also be made with abstract motifs for interesting visual effects, as shown in FIGS. 3 A–D. As can be seen in these figures, the shape of the tabs 12 and the slots 16 can be varied so that they reflect the abstract motifs, as long as they retain their functional characteristics that allow the links to interlock. For the tab 12 these characteristics are the narrow neck 18 which widens into the head 20 of the tab, and for the slot 16 they include the wide mouth 22 and a narrow throat 24, which connects it to the base 26 of the slot. Quite a bit of variation of the geometry is allowable as long as these features are preserved.

Figure 4A:
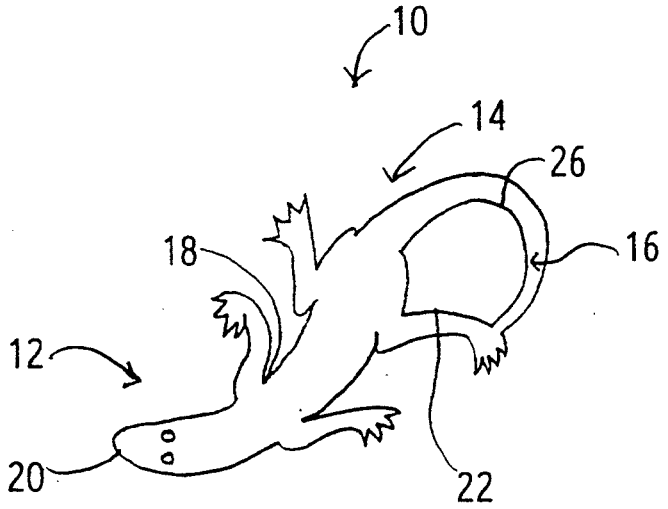
FIGS. 4 A–B show variations of the chain links having motifs from nature.
Figure 4B:
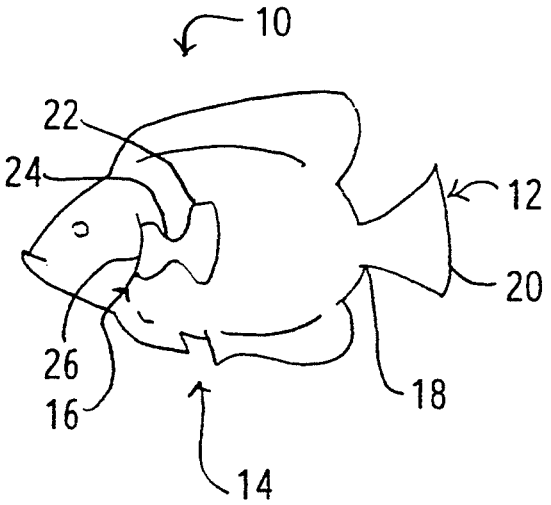

This flexibility also allows the chain links to be made in motifs drawn from nature. FIG. 4A shows a chain link made in the shape of a fish and FIG. 4B shows a chain link made in the shape of a salamander. Note that the functional design of the tabs 12 and the slots 16 have been made an integral part of the aesthetic design of the chain links. Many different animal shapes may be used for the chain links to create an entire menagerie of interlocking links.

Figure 5B:
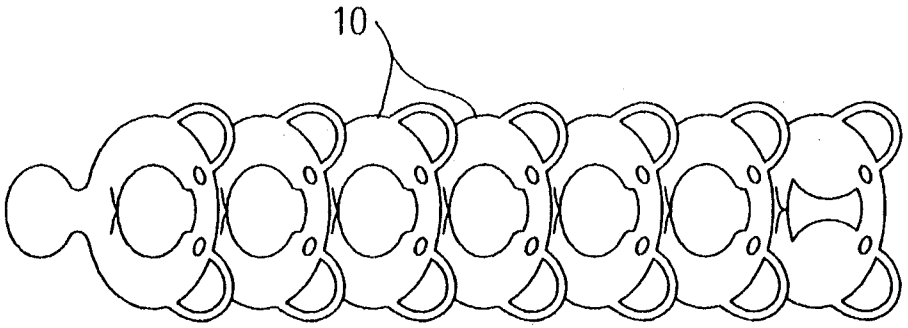
FIGS. 5 A–B show a chain with links having a motif suitable for children's jewelry.
Figure 5A:
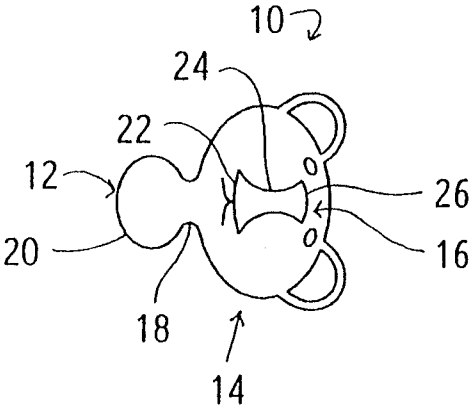

FIG. 5A shows an example of a chain link with a motif suitable for children's costume jewelry. The body 14 of the link is made in the shape of the head of a Teddy bear with the slot 16 positioned where the nose of the bear belongs. The tab 12 of the link is made in the shape of the bear's nose. When the links are joined together as shown in FIG. 5B the tab 12 of each link becomes the nose in the head of the adjacent link. When made as children's costume jewelry, the invention has added value as a dexterity-increasing assembly toy and it has amusement value for the child because when the chain is flexed the noses of the Teddy bears can be seen to wiggle. The tabs and the slots of the links may be made so that they will only attach to one another in a certain order, thereby creating a sort of a puzzle that helps to exercise a child's reasoning, as well as dexterity.

Figure 6A:
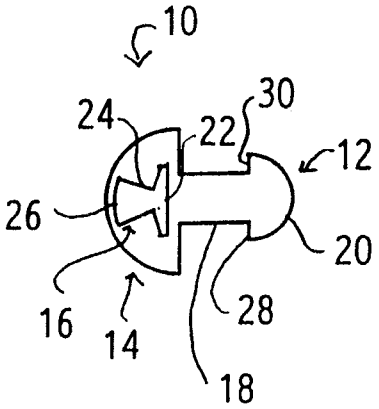
FIGS. 6 A–B show a chain with links having a shoulder for more secure attachment of the interlocking links.
Figure 6B:
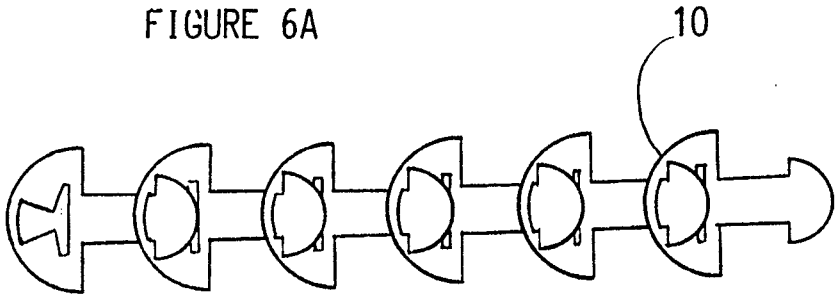

FIGS. 6 A–B show an embodiment of the invention which is designed to provide an even more secure interlock between adjoining links of the chain. A single chain link 10 is shown in FIG. 6A. Analogously to the other embodiments described, the chain link 10 has a body 14 which has a slot portion 16 and a tab portion 12. The slot 16 has a wide mouth 22 which is connected to the base 26 of the slot by a narrow throat 24. The tab portion 12 has a narrow neck 18 which extends from the body 14 and widens to form the head 20 of the tab. The head 20 of the tab has a pair of shoulders 28, 30 at the transition between the head 20 and the neck 18. The width of the head 20, including the shoulders 28, 30, is actually wider than the mouth 22 of the slot 16. The tab 12 of a link 10 can be inserted into the slot 16 of an adjacent link 10 by first hooking one shoulder 28 into the mouth 22 of the slot 16, then rotating the links with respect to one another until the second shoulder 30 slides into the mouth 22 of the slot 16. Then the first link 10 can be rotated approximately 90 degrees so that the neck 18 of the tab 12 can be passed through the throat 24 in the second link until it is in the base 26 of the slot 16. The first link 10 is rotated back again and the two links are firmly, yet flexibly, interlocked. By repeating this process a number of links 10 can be joined together to form a chain as shown in FIG. 6B. Because the width of the head 20, including the shoulders 28, 30, is wider than the mouth 22 of the slot 16, it is highly unlikely that the interlocking links will become disengaged, except when they are deliberately detached by reversing the above process.

Although the examples given include many specificities, they are intended as illustrative of only some of the possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A link chain comprising a plurality of interlocking links, each of said links comprising:

a link body, a slot formed within said link body having a mouth, a base, and a narrow throat which connects said mouth of said slot to said base of said slot, said throat being narrower than either said mouth or said base, and a tab projecting from said link body having a neck which is attached to said link body, said neck terminating in a head which is wider than said neck, and said mouth of said slot being wide enough to allow insertion of said head of said tab, and said base being wider than said neck of said tab and narrower than said head of said tab, whereby said plurality of interlocking links can be joined together by inserting the tab of each link into the slot of an adjacent link, thereby interlinking said links into a chain.

2. The link chain of claim 1, wherein said tab further comprises a pair of shoulders extending from said head where said head joins said neck, the width of said head, including said shoulders, being greater than the width of said mouth of said slot, the tab of one link being insertable into the slot of an adjacent link by hooking one shoulder of said tab into the mouth of said slot and rotating one link with respect to the other until the second shoulder and the head of said tab enters said mouth of said slot.

3. The link chain of claim 1, wherein said plurality of interlocking links are made of a substantially planar material.

4. The link chain of claim 1, wherein the link body of at least one of said plurality of links is decorated to depict an animal or character and the tab of an adjacent link is decorated to depict a part associated with said animal or character.

5. The link chain of claim 1, wherein the link body of at least one of said plurality of links is decorated to depict an animal or character and the tab of an adjacent link is decorated to depict a part associated with said animal or character, such that when said tab of said adjacent link is inserted into the slot of said at least one of said plurality of links and said adjacent link is moved with respect to said at least one of said plurality of links, said part appears to move with respect to said animal or character.

6. The link chain of claim 1, wherein said plurality of interlocking links are made of a substantially planar material.

7. A link chain comprising a plurality of interlocking links, including:

a first link comprising a first link body having a slot formed within said first link body, said first link body being decorated to depict a recognizable animal or character figure, a second link comprising a second link body having a tab projecting from said link body, said tab being decorated to depict a part associated with said recognizable animal or character figure, wherein when said tab of said second link is inserted into said slot of said first link and said second link is moved with respect to said first, said part appears to move with respect to said recognizable animal or character figure, and wherein said tab has a neck which is attached to said second link body, said neck terminating in a head which is wider than said neck, and said slot has a mouth and a base, said mouth of said slot being wide enough to allow insertion of said head of said tab, and said base being wider than said neck of said tab and narrower than said head of said tab, said second link further comprising a narrow throat which connects said mouth of said slot to said base of said slot, said throat being narrower than either said mouth or said base.

8. The link chain of claim 7, wherein said tab further comprises a pair of shoulders extending from said head where said head joins said neck, the width of said head, including said shoulders, being greater than the width of said mouth of said slot, said tab being insertable into said slot by hooking one shoulder of said tab into the mouth of said slot and rotating one link with respect to the other until the second shoulder and the head of said tab enters said mouth of said slot.

* * * * *